US011232656B2

(12) United States Patent
Jun et al.

(10) Patent No.: US 11,232,656 B2
(45) Date of Patent: Jan. 25, 2022

(54) APPARATUS FOR RECORDING IMAGE FOR VEHICLE, SYSTEM HAVING THE SAME, AND METHOD THEREOF

(71) Applicants: Hyundai Motor Company, Seoul (KR); Kia Motors Corporation, Seoul (KR)

(72) Inventors: Sung Hwan Jun, Hwaseong-si (KR); Kyoung Jun Kim, Ulsan (KR); Dong Hyuk Jeong, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 107 days.

(21) Appl. No.: 16/661,630

(22) Filed: Oct. 23, 2019

(65) Prior Publication Data

US 2021/0012589 A1 Jan. 14, 2021

(30) Foreign Application Priority Data

Jul. 12, 2019 (KR) ..... 10-2019-0084431

(51) Int. Cl.
*G07C 5/08* (2006.01)

(52) U.S. Cl.
CPC ..... *G07C 5/085* (2013.01)

(58) Field of Classification Search
CPC ..... G07C 5/085
See application file for complete search history.

(56) References Cited

U.S. PATENT DOCUMENTS

2009/0306848 A1* 12/2009 Kohsaka ..... G07C 5/085 701/31.4
2020/0201335 A1* 6/2020 Somers ..... G05D 1/0223
2020/0363818 A1* 11/2020 Li ..... G08G 1/163

OTHER PUBLICATIONS

English translation of Hyuk, KR 2011-0005994 A, Published Jan. 20, 2011, pp. 3-5 (Year: 2011).*
English translation of Shoichiro, JP 4186356 B2, Published Nov. 26, 2008, pp. 3-5 (Year: 2008).*

* cited by examiner

*Primary Examiner* — James J Lee
*Assistant Examiner* — Wenyuan Yang
(74) *Attorney, Agent, or Firm* — Morgan, Lewis & Bockius LLP

(57) ABSTRACT

An apparatus for recording an image of a vehicle includes: a processor that determines whether an impact of a reference value or more applied to the vehicle is caused by an accident, by using a signal of an in-vehicle communication network, and performs control to not record a vehicle image for a predetermined exception handling time, when the processor determines that the impact is not caused by the accident; and a storage controlled by the processor to record the vehicle image.

7 Claims, 5 Drawing Sheets

APPARATUS FOR RECORDING IMAGE FOR VEHICLE, SYSTEM HAVING THE SAME, AND METHOD THEREOF

CROSS-REFERENCE TO RELATED APPLICATION

This application claims the benefit of priority to Korean Patent Application No. 10-2019-0084431, filed in the Korean Intellectual Property Office on Jul. 12, 2019, the entire contents of which are incorporated herein by reference.

TECHNICAL FIELD

The present disclosure relates to an apparatus for recording an image of a vehicle, a system having the same, and a method thereof, and more particularly, relates to a vehicle image recording technology for performing exception handling of an impact detected when a door of a vehicle is opened or closed.

BACKGROUND

In general, a vehicle image recording apparatus (a black box) includes one or more cameras for taking images of surroundings of a vehicle. The vehicle image recording apparatus detects a direction (e.g., a fore/aft, left/right, or up/down direction) in which an impact is applied to the vehicle, based on a measurement value of an impact sensor (a 3-axis G-sensor) according to the impact applied to the vehicle and detects a portion of the vehicle to which the impact is applied, based on an image taken with a camera located in the impact direction of the vehicle.

The vehicle image recording apparatus in the related art often takes and records an image by misidentifying an impact occurring when a door, a hood, or a trunk is opened or closed under a normal vehicle usage condition, as an impact caused by an accident.

Due to the unnecessary photographing and recording caused by the misidentification, power and memory may be unnecessarily consumed.

SUMMARY

The present disclosure has been made to solve the above-mentioned problems occurring in the prior art while advantages achieved by the prior art are maintained intact.

An aspect of the present disclosure provides an apparatus for recording an image of a vehicle, a system having the same, and a method thereof, in which the apparatus is aimed at preventing erroneous or unnecessary recording by performing exception handling of unnecessary impacts, such as impacts imposed on the vehicle when doors (e.g., a door, a hood, a trunk, a tailgate, and the like) of the vehicle are opened or closed, in conjunction with an in-vehicle communication network.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, an apparatus for recording an image of a vehicle includes: a processor that determines whether an impact of a reference value or more applied to the vehicle is caused by an accident, by using a signal of an in-vehicle communication network and performs control to not record a vehicle image for a predetermined exception handling time, when the processor determines that the impact is not caused by the accident; and a storage controlled by the processor to record the vehicle image.

The processor may determine a transition of a Controller Area Network (CAN) communication signal of the in-vehicle communication network for a predetermined period of time after the occurrence of the impact and may determine that the impact is caused by the accident, when the transition of the CAN communication signal does not occur.

The processor may set the predetermined exception handling time in advance by setting, as a margin, maximum time during which an aftershock occurs after the first impact.

The processor may monitor a transition of a CAN communication signal of the in-vehicle communication network for predetermined monitoring time after the occurrence of the impact.

The processor may set the sum of a maximum period of the communication signal and maximum latency as the monitoring time in advance.

A CAN communication signal of the in-vehicle communication network may include at least one of open/close signals of doors, an open/close signal of a trunk, an open/close signal of a hood, or an open/close signal of a tailgate.

According to another aspect of the present disclosure, a vehicle system includes: a sensing device that senses an impulse of a vehicle; and a vehicle image recording apparatus that determines whether an impact is caused by an accident by using a signal of an in-vehicle communication network when the impulse of the vehicle received from the sensing device is greater than or equal to a reference value, and that performs control to not record a vehicle image for a predetermined exception handling time when the vehicle image recording apparatus determines that the impact is not caused by the accident.

The vehicle image recording apparatus may determine a transition of a Controller Area Network (CAN) communication signal of the in-vehicle communication network for a predetermined period of time after the occurrence of the impact and may determine that the impact is caused by the accident, when the transition of the CAN communication signal does not occur.

The vehicle image recording apparatus may set the predetermined exception handling time in advance by setting, as a margin, maximum time during which an aftershock occurs after the first impact.

The vehicle image recording apparatus may monitor a transition of a CAN communication signal of the in-vehicle communication network for predetermined monitoring time after the occurrence of the impact.

The vehicle image recording apparatus may set the sum of a maximum period of the communication signal and maximum latency as the monitoring time in advance.

According to another aspect of the present disclosure, a method for recording an image of a vehicle includes: determining whether an impact of a reference value or more is applied to the vehicle; determining whether the impact is caused by an accident by using a signal of an in-vehicle communication network when it is determined that the impact of the reference value or more is applied to the vehicle; and performing control to not record a vehicle image for a predetermined exception handling time when it is determined that the impact is not caused by the accident.

A Controller Area Network (CAN) communication signal of the in-vehicle communication network may include at least one of open/close signals of doors, an open/close signal of a trunk, an open/close signal of a hood, or an open/close signal of a tailgate.

The method may further include setting the predetermined exception handling time in advance by setting, as a margin, maximum time during which an aftershock occurs after the first impact.

The method may further include monitoring a transition of a CAN communication signal of the in-vehicle communication network for predetermined monitoring time after the occurrence of the impact.

The method may further include setting the sum of a maximum period of the communication signal and maximum latency as the monitoring time in advance.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
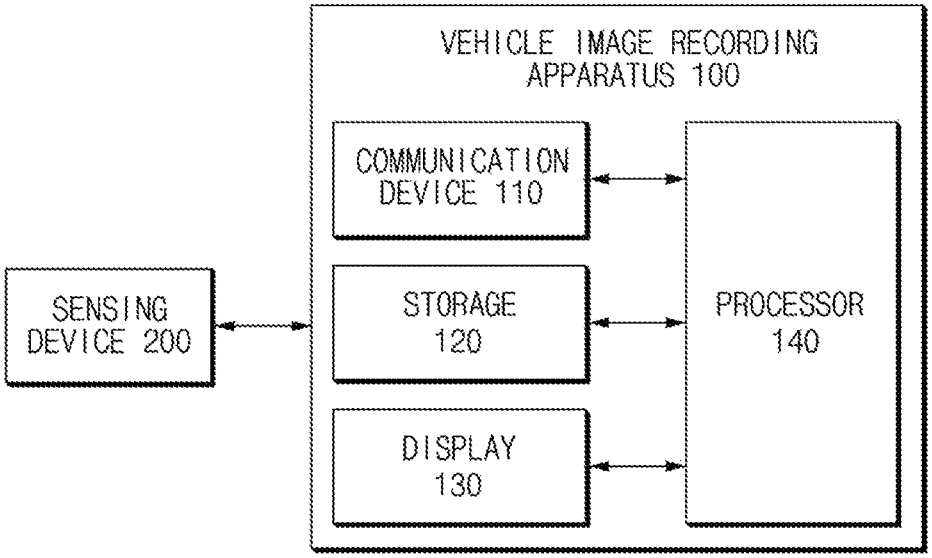
FIG. 1 is a block diagram illustrating a configuration of a vehicle system including a vehicle image recording apparatus according to an exemplary embodiment of the present disclosure.

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiment of the present disclosure, a detailed description of well-known features or functions will be ruled out in order not to unnecessarily obscure the gist of the present disclosure.

In describing the components of the embodiment according to the present disclosure, terms such as first, second, "A", "B", (a), (b), and the like may be used. These terms are merely intended to distinguish one component from another component, and the terms do not limit the nature, sequence or order of the components. Unless otherwise defined, all terms used herein, including technical or scientific terms, have the same meanings as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

In a vehicle image recording apparatus for taking images of surroundings of a vehicle and recording the images when an impact by a vehicle accident occurs, a technology for performing control not to record impacts caused by opening/closing of doors when the impact by the vehicle accident occurs is disclosed in the present disclosure.

Hereinafter, embodiments of the present disclosure will be described in detail with reference to FIGS. 1 to 5.

FIG. 1 is a block diagram illustrating a configuration of a vehicle system including a vehicle image recording apparatus according to an exemplary embodiment of the present disclosure.

Referring to FIG. 1, a vehicle system according to an exemplary embodiment of the present disclosure may include a vehicle image recording apparatus 100 and a sensing device 200.

The vehicle image recording apparatus 100 may determine whether an impact of a predetermined reference value or more that is applied to a vehicle corresponds to an impact caused by an accident by using a signal of an in-vehicle communication network. When it is determined that the impact is not caused by an accident, the vehicle image recording apparatus 100 may perform control not to record a vehicle image for a predetermined exception handling time.

The vehicle image recording apparatus 100 may include a communication device 110, storage 120, a display 130, and a processor 140.

The communication device 110 is a hardware device that is implemented with various electronic circuits to transmit and receive signals via wireless or wired connection. In this disclosure, the communication device 110 may perform in-vehicle communication via Controller Area Network (CAN) communication, Local Interconnect Network (LIN) communication, or Ethernet communication and may perform communication with the sensing device 200.

The storage 120 may store a sensing result (an impulse) that is obtained by the sensing device 200 and image data that is taken when the impact is applied to the vehicle and that is obtained by the processor 140. The storage 120 may include at least one type of storage medium among memories of a flash memory type, a hard disk type, a micro type, and a card type (e.g., a secure digital (SD) card or an eXtream digital (XD) card) and memories of a random access memory (RAM) type, a static RAM (SRAM) type, a read-only memory (ROM) type, a programmable ROM (PROM) type, an electrically erasable PROM (EEPROM) type, a magnetic RAM (MRAM) type, a magnetic disk type, or an optical disk type.

The display 130 may display an image of a portion of the vehicle to which the impact is applied, when a user makes a request to display the image. The display 130 may be implemented with a head-up display (HUD), a cluster, an audio video navigation (AVN), or the like. The display 130 may include at least one of a liquid crystal display (LCD), a thin film transistor-LCD (TFT LCD), a light emitting diode (LED) display, an organic LED (OLED) display, an active matrix OLED (AMOLED) display, a flexible display, a bended display, or a 3D display. Some of the displays may be implemented as a transparent display of a transparent or translucent type such that the outside can be viewed therethrough. Furthermore, the display 130 may be implemented with a touch screen including a touch panel and may be used as an input device as well as an output device.

The processor 140 may be electrically connected with the communication device 110, the storage 120, and the display 130 and may electrically control the components. The processor 140 may be electric circuitry that executes commands of software and may perform various data processing or computation, which will be described below.

The processor 140 may determine whether an impact of a predetermined reference value or more that is applied to the vehicle corresponds to an impact caused by an accident, by using a signal of an in-vehicle communication network. When it is determined that the impact is not caused by an accident, the processor 140 may perform control not to record a vehicle image for a predetermined exception handling time. In contrast, when it is determined that the impact is caused by an accident, the processor 140 may control the sensing device 200 to perform image recording.

A CAN communication signal of the in-vehicle communication network may include at least one of open/close signals of doors, an open/close signal of a trunk, an open/close signal of a hood, or an open/close signal of a tailgate.

The processor 140 may determine a transition of the CAN communication signal of the in-vehicle communication network for a predetermined period of time after the occurrence of the impact. When it is determined that the CAN communication signal does not transition, the processor 140 may determine that the impact is caused by an accident.

The processor 140 may set the predetermined exception handling time in advance by setting, as a margin, maximum time during which an aftershock occurs after the first impact.

The processor 140 may monitor a transition of the CAN communication signal of the in-vehicle communication network for predetermined monitoring time after the occurrence of the impact.

The processor 140 may set the sum of a maximum period of the communication signal and maximum latency as the monitoring time in advance.

Values that determine the communication signal monitoring time after the occurrence of the impact and the impact detection exception-handling time are listed in Table 1 below.

TABLE 1

| Time | Contents |
|---|---|
| Communication signal monitoring time after occurrence of impact | Maximum period of communication signal + Maximum latency |
| Impact detection exception-handling time | Maximum time during which aftershock occurs after impact + Margin time |

The sensing device 200 may include a plurality of sensors to sense the impact applied to the vehicle, the direction (e.g., a fore/aft, left/right, or up/down direction) in which the impact occurs, and the position of the impact. That is, the sensing device 200 may include an impact sensor (e.g., a 3-axis G-sensor) that senses the impact applied to the vehicle. Furthermore, the sensing device 200 may include cameras for taking an image to determine a collision by an accident. The cameras may be mounted on a front side, a rear side, and opposite lateral sides of the vehicle to photograph the front, rear, and opposite sides of the vehicle. The cameras may be controlled by the vehicle image recording apparatus 100 to photograph a collision direction (a collision point).

Figure 2:
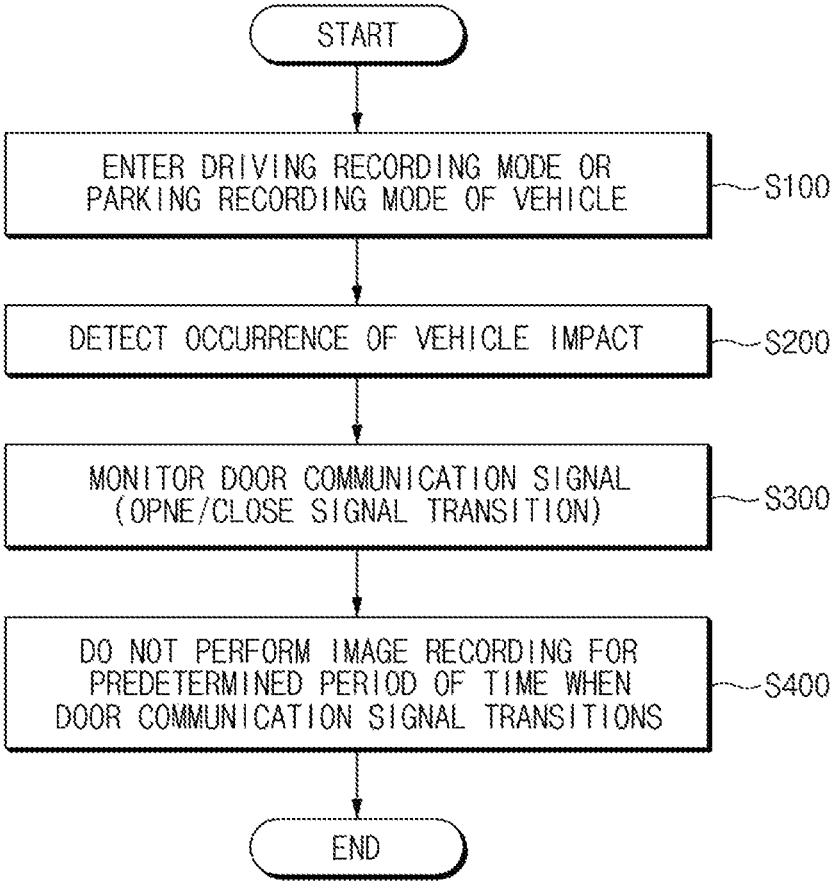
FIG. 2 is a flowchart illustrating a vehicle image recording method according to an exemplary embodiment of the present disclosure.

Hereinafter, a vehicle image recording method according to an exemplary embodiment of the present disclosure will be described in detail with reference to FIG. 2. FIG. 2 is a flowchart illustrating the vehicle image recording method according to an exemplary embodiment of the present disclosure.

Hereinafter, it is assumed that the vehicle image recording apparatus 100 of FIG. 1 performs the process of FIG. 2. Furthermore, it may be understood that operations set forth as being performed by the apparatus in the description of FIG. 2 are controlled by the processor 140 of the vehicle image recording apparatus 100.

Referring to FIG. 2, the vehicle image recording apparatus 100 may enter a driving recording mode or a parking recording mode of a vehicle and may maintain a recording standby state in which the vehicle image recording apparatus 100 is capable of making a record at any time (S100).

When detecting occurrence of an impact during the driving recording mode or the parking recording mode (S200), the vehicle image recording apparatus 100 monitors a door communication signal (S300). When the door communication signal transitions from an open state to a closed state, the vehicle image recording apparatus 100 may determine that the impact is caused by opening/closing of a door and may perform control not to record an image for a predetermined period of time (S400).

When the impact is applied to the vehicle as described above, the vehicle image recording apparatus 100 has to determine image recording detection criteria by identifying whether the impact is an impact under a customer usage condition or an external impact, by monitoring in-vehicle communication for a predetermined period of time after the occurrence of the impact in view of the difference between recognized G-value (impact value) sampling time and communication signal transition time. A signal by which an operation is able to be determined via the in-vehicle communication network while an impact is applied to the vehicle under the customer usage condition may include open/close signals of doors (FL/FR/RL/RR doors), an open/close signal of a hood, and an open/close signal of a trunk.

When the impact applied to the vehicle is determined to be an impact under the customer usage condition, the vehicle image recording apparatus 100 may perform exception handling such that image recording is not performed for a predetermined period of time, thereby preventing detection of an unnecessary impact. Furthermore, when the impact applied to the vehicle is determined to be an external impact by which a door open/close signal is not changed, the vehicle image recording apparatus 100 may perform control to record an image by applying existing impact detection criteria.

Figure 3:
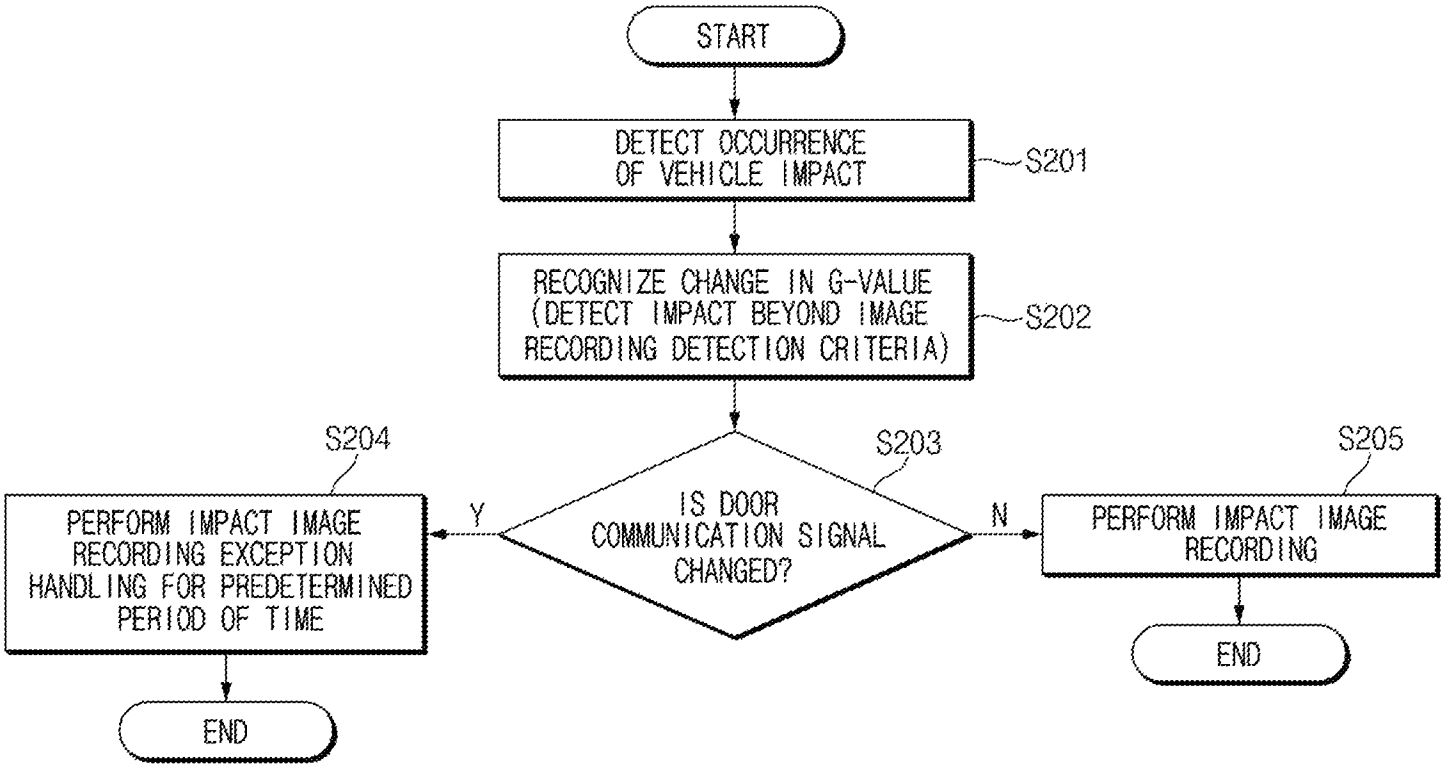
FIG. 3 is a flowchart illustrating a vehicle image recording exception-handling method according to an exemplary embodiment of the present disclosure.

Hereinafter, a vehicle image recording exception-handling method according to an exemplary embodiment of the present disclosure will be described in detail with reference to FIG. 3. FIG. 3 is a flowchart illustrating the vehicle image recording exception-handling method according to an exemplary embodiment of the present disclosure.

Hereinafter, it is assumed that the vehicle image recording apparatus 100 of FIG. 1 performs the process of FIG. 3. Furthermore, it may be understood that operations set forth as being performed by the apparatus in the description of FIG. 3 are controlled by the processor 140 of the vehicle image recording apparatus 100.

When detecting an impact applied to the vehicle (S201), the vehicle image recording apparatus 100 recognizes a change in G-value (impact value) and determines whether the impact is beyond image recording detection criteria (S202).

When it is determined that the impact is beyond the image recording detection criteria, the vehicle image recording apparatus 100 determines whether a door communication signal transitions (S203). When it is determined that the door communication signal transitions from an open state to a closed state, the vehicle image recording apparatus 100 performs impact image recording exception handling for a predetermined period of time (S204), and when it is determined that the door communication signal does not transition, the vehicle image recording apparatus 100 determines that the impact is caused by an accident and records an impact image (S205).

As described above, when an impact occurs in a normal customer usage state, the vehicle image recording apparatus 100 of the present disclosure does not perform vehicle image recording, by using detection of the impact by the sensing device 200 (the G-sensor) and in-vehicle communication network interlocking monitoring. When various impacts other than an impact caused by opening/closing of a door occur, the vehicle image recording apparatus 100 may determine whether to perform vehicle image recording, by identifying whether the impacts are caused by accidents or vehicle operations, based on corresponding communication signals.

Figure 4:
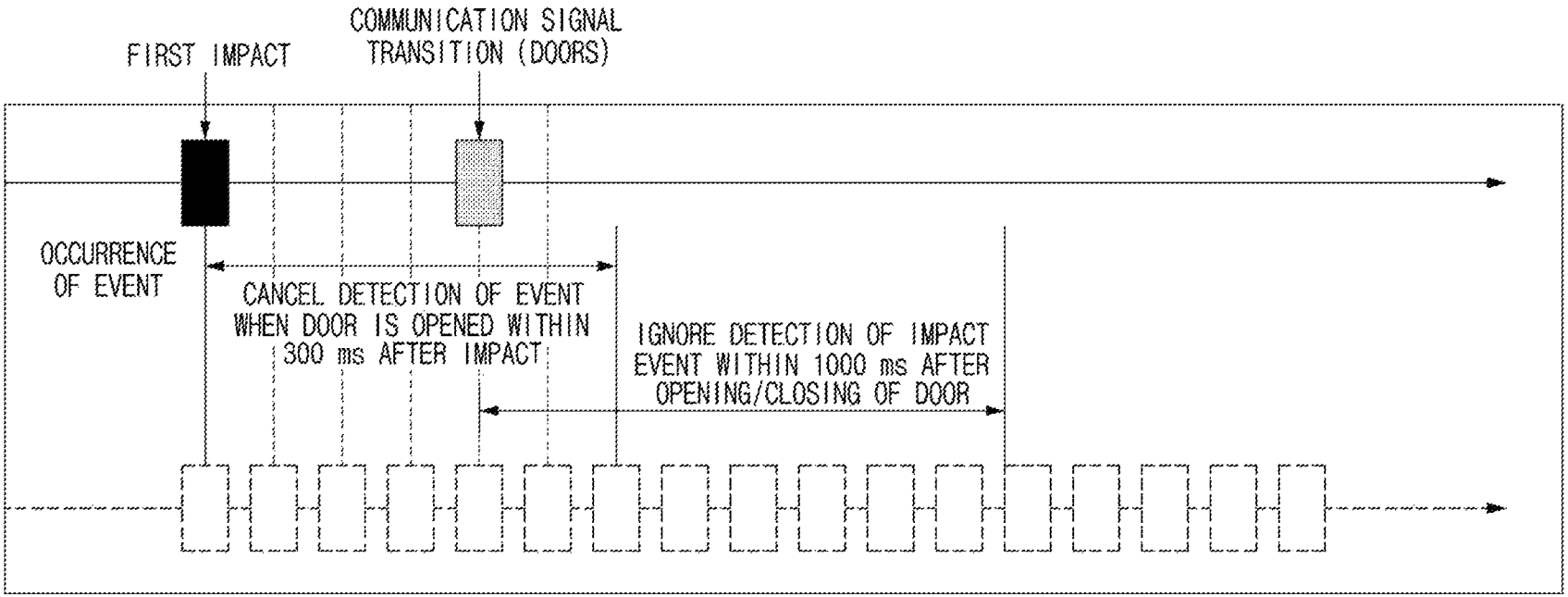
FIG. 4 is a view illustrating a process of performing exception handling of impacts caused by opening/closing of doors during vehicle image recording according to an exemplary embodiment of the present disclosure.

FIG. 4 is a view illustrating a process of performing exception handling of impacts caused by opening/closing of doors during vehicle image recording according to an exemplary embodiment of the present disclosure.

When an impact is applied to a vehicle, the impact sensor (the G-sensor) of the sensing device 200 detects the impact and transmits the G-value (impact value) to the vehicle image recording apparatus 100. Because the impact sampling period of the impact sensor is usually shorter than the in-vehicle communication period, the vehicle image recording apparatus 100 first recognizes a G-value beyond the detection criteria when the impact is applied to the vehicle.

When recognizing the G-value beyond the image recording detection criteria, the vehicle image recording apparatus 100 monitors "door/trunk/hood" open/close signals for a period of time determined by experimental values in advance from the time of recognition. When a transition of a communication signal (e.g., FR_DOOR CAN signal=0x0 (Close)→0x1 (Open)), which is monitored for the predetermined period of time after the occurrence of the impact, does not occur, the vehicle image recording apparatus 100 performs image recording.

When a transition of a set communication signal is detected for the monitoring time, an "image recording (storing) exception-handling timer" that does not perform image recording for a detected impact for a predetermined period of time operates, and image recording is not performed even though an impact beyond the image recording detection criteria is recognized for the corresponding time.

Referring to FIG. 4, when a CAN communication signal related to opening/closing of a door/trunk/hood transitions within a predetermined period of time (e.g., 300 msec) after detection of the first impact, the vehicle image recording apparatus 100 performs exception handling of impact detection for a predetermined period of time (e.g., 1 sec) from the time when the CAN communication signal transitions. For example, when the period of an impact sensor is 10 msec and the period of a door/hood/trunk CAN communication signal is 100/200 msec, a transition of the CAN communication signal may be identified in advance by an experimental value within the sum of a communication period after occurrence of a vehicle impact and maximum latency (50% of the period). Furthermore, in the case of logic to perform exception handling for 1 sec, a G-value beyond the detection criteria may be applied for a maximum of 500 msec to 700 msec by an aftershock after occurrence of the first impact in the case of very strong door closing through a principle experiment.

As described above, when a normal customer usage signal transition is detected for a predetermined period of time immediately after occurrence of an impact, the impact is determined to be a normal impact, and exception handling of image recording is performed for a predetermined period of time. The width of the exception handling signal selection may vary depending on a vehicle model and an in-vehicle communication controller signal of an Original Equipment Manufacturer (OEM). In this disclosure, an impact when a door is opened or closed exemplifies an impact that is not caused by an accident. However, without being limited thereto, the present disclosure is applicable to all general impacts other than an impact caused by an accident during operations such as normal vehicle parking, stopping, and driving.

A vehicle image recording apparatus (a black box) in the related art has an algorithm to perform image recording when recognizing a G-value beyond impact detection criteria. Therefore, the conventional vehicle image recording apparatus has a problem in that image recording is performed even in ordinary situations such as open/closing of doors. To solve this problem, the present disclosure performs exception handling of image recording for an unnecessary impact such as opening/closing of doors, thereby improving a commercial value.

One of reasons why a customer, when using a black box product, does not play an image in detail after identifying a popup "New impact is detected" is because the customer habitually recognizes the fact that the image recording apparatus (black box) detects an impact caused by normal use such as opening/closing of a door. Accordingly, the present disclosure prevents detection of an unnecessary impact to the maximum, thereby providing an effect of inducing a user to identify an image for new impact notification one more time and calling a customer's attention to a minute accident situation.

Figure 5:
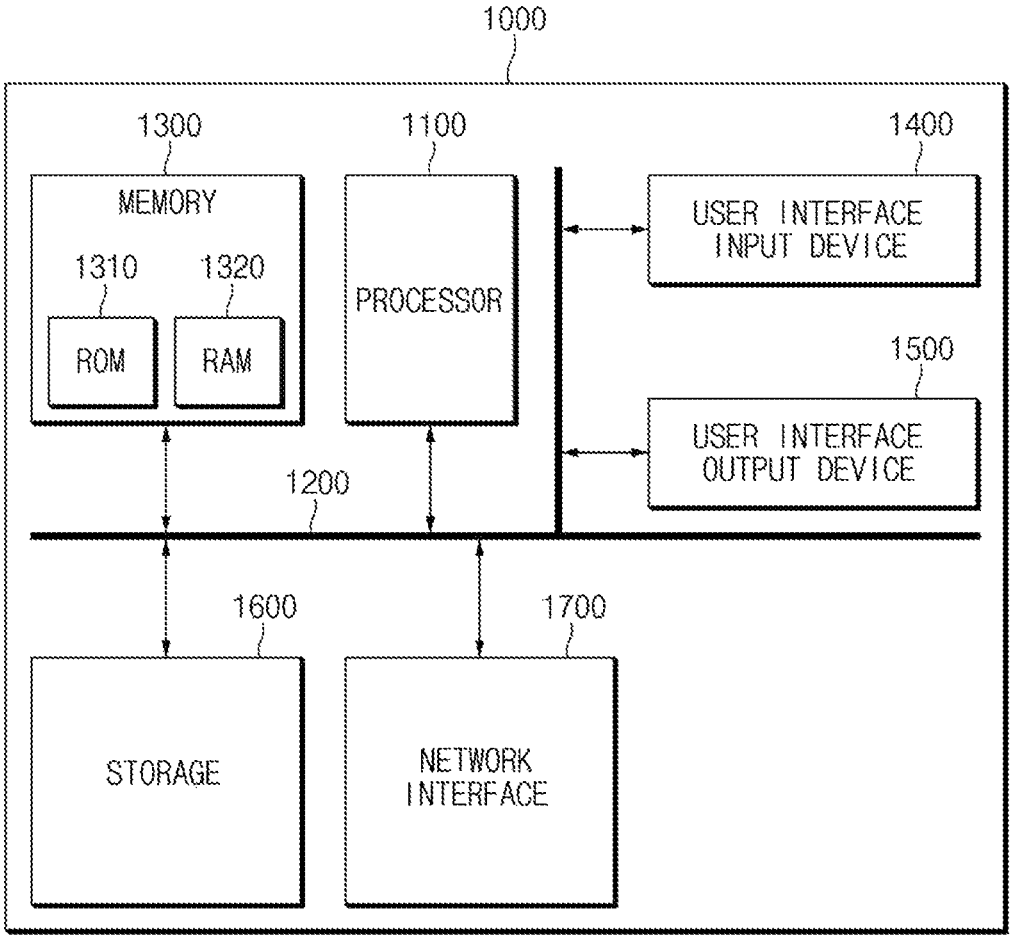
FIG. 5 illustrates a computing system according to an exemplary embodiment of the present disclosure.

FIG. 5 illustrates a computing system according to an exemplary embodiment of the present disclosure.

Referring to FIG. 5, the computing system 1000 may include at least one processor 1100, a memory 1300, a user interface input device 1400, a user interface output device 1500, storage 1600, or a network interface 1700, which are connected with each other via a bus 1200.

The processor 1100 may be a central processing unit (CPU) or a semiconductor device that processes instructions stored in the memory 1300 and/or the storage 1600. The memory 1300 and the storage 1600 may include various types of volatile or non-volatile storage media. For example, the memory 1300 may include a ROM (Read Only Memory) 1310 and a RAM (Random Access Memory) 1320.

Thus, the operations of the method or the algorithm described in connection with the embodiments disclosed herein may be embodied directly in hardware or a software module executed by the processor 1100, or in a combination thereof. The software module may reside on a storage medium (that is, the memory 1300 and/or the storage 1600) such as a RAM, a flash memory, a ROM, an EPROM, an EEPROM, a register, a hard disk, a removable disk, or a CD-ROM.

The exemplary storage medium may be coupled to the processor 1100, and the processor 1100 may read information out of the storage medium and may record information in the storage medium. Alternatively, the storage medium may be integrated with the processor 1100. The processor 1100 and the storage medium may reside in an application specific integrated circuit (ASIC). The ASIC may reside within a user terminal. In another case, the processor 1100 and the storage medium may reside in the user terminal as separate components.

The technology according to the present disclosure may prevent erroneous or unnecessary recording by performing exception handling of unnecessary impacts, such as impacts imposed on a vehicle when doors (e.g., a door, a hood, a trunk, a tailgate, and the like) of the vehicle are opened or closed, in conjunction with an in-vehicle communication network.

In addition, the present disclosure may provide various effects that are directly or indirectly recognized.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

Therefore, the exemplary embodiments of the present disclosure are provided to explain the spirit and scope of the present disclosure, but not to limit them, so that the spirit and scope of the present disclosure is not limited by the embodiments. The scope of the present disclosure should be construed on the basis of the accompanying claims, and all the technical ideas within the scope equivalent to the claims should be included in the scope of the present disclosure.

What is claimed is:

1. An apparatus for recording an image of a vehicle, the apparatus comprising:

a processor configured to:

determine whether an impact of a reference value or more applied to the vehicle is caused by an accident, by using a signal of an in-vehicle communication network, and perform control to not record a vehicle image for a predetermined exception handling time, when the processor determines that the impact is not caused by the accident; and a storage controlled by the processor to record the vehicle image, wherein the processor sets the predetermined exception handling time in advance by setting, as a margin, a maximum time during which an aftershock occurs after the impact, wherein the processor monitors a transition of a communication signal related to opening or closing of at least one of door, trunk, hood, or tailgate of the vehicle within the in-vehicle communication network for a predetermined period of monitoring time after the impact, and wherein the processor sets a sum of a maximum transition period of the communication signal and a maximum latency of the communication signal as the predetermined period of monitoring time in advance.

2. The apparatus of claim 1, wherein the processor determines a transition of a Controller Area Network (CAN) communication signal of the in-vehicle communication network for a predetermined period of time after the impact and determines that the impact has been caused by the accident when the transition of the CAN communication signal does not occur.

3. The apparatus of claim 1, wherein the communication signal related to the opening or closing of the least one of door, trunk, hood, or tailgate of the vehicle is included in a CAN communication signal of the in-vehicle communication network.

4. A vehicle system comprising:

a sensing device configured to sense an impulse of a vehicle; and a vehicle image recording apparatus configured to:

determine whether an impact is caused by an accident, by using a signal of an in-vehicle communication network, when the impulse received from the sensing device is greater than or equal to a reference value, perform control to not record a vehicle image for a predetermined exception handling time when the vehicle image recording, apparatus determines that the impact is not caused by the accident, set the predetermined exception handling time in advance by setting, as a margin, a maximum time during which an aftershock occurs after the impact, monitor a transition of a communication signal related to opening or closing of at least one of door, trunk, hood, or tailgate of the vehicle within the in-vehicle communication network for a predetermined period of monitoring time after the occurrence of the impact, and set a sum of a maximum transition period of the communication signal and a maximum latency of the communication signal as the predetermined period of monitoring time in advance.

5. The vehicle system of claim 4, wherein the vehicle image recording apparatus determines a transition of a Controller Area Network (CAN) communication signal of the in-vehicle communication network for a predetermined period of time after the impact has caused, and determines that the impact is caused by the accident when the transition of the CAN communication signal has not occurred.

6. A method for recording an image of a vehicle, the method comprising:

determining whether an impact of a reference value or more is applied to the vehicle;

determining whether the impact is caused by an accident, by using a signal of an in-vehicle communication network when it is determined that the impact of the reference value or more is applied to the vehicle;

performing control to not record a vehicle image for a predetermined exception handling time when it is determined that the impact is not caused by the accident, wherein the performing control includes setting the predetermined exception handling time in advance by setting, as a margin, a maximum time during which an aftershock occurs after the impact, monitoring a transition of a communication signal related to opening or closing of at least one of door, trunk, hood, or tailgate of the vehicle within the in-vehicle communication network for a predetermined period of monitoring time after the occurrence of the impact; and setting a sum of a maximum transition period of the communication signal and a maximum latency of the communication signal as the predetermined period of monitoring time in advance.

7. The method of claim 6, wherein the communication signal related to the opening or closing of the least one of door, trunk, hood, or tailgate of the vehicle is included in a CAN communication signal of the in-vehicle communication network.

* * * * *